US006209654B1

(12) United States Patent
Curless

(10) Patent No.: US 6,209,654 B1
(45) Date of Patent: Apr. 3, 2001

(54) DELUGE FIRE SPRINKLER SYSTEM

(76) Inventor: Mac Curless, 229 Spruce Ave., P.O. Box 311, Yachats, OR (US) 97498-0311

( * ) Notice: Subject to any disclaimer, the term of this patent is extended or adjusted under 35 U.S.C. 154(b) by 0 days.

(21) Appl. No.: 09/619,202

(22) Filed: Jul. 19, 2000

(51) Int. Cl.[7] ..... A62C 35/00

(52) U.S. Cl. ..... 169/17; 169/37; 169/42; 239/209; 137/74

(58) Field of Search ..... 169/37, 38, 39, 169/5, 16–19, 20; 239/42, 208, 209; 137/74, 72, 489

(56) References Cited

U.S. PATENT DOCUMENTS 3,759,331 * 9/1973 Livingston ..... 169/17
3,888,313 * 6/1975 Freeman ..... 169/37

* cited by examiner

*Primary Examiner*—Lisa Ann Douglas

(74) *Attorney, Agent, or Firm*—Kenneth H. Jack; Davis & Jack, L.L.C.

(57) ABSTRACT

A deluge fire sprinkler system for suppressing fires occurring in an air environment, the air having an atmospheric pressure, the deluge fire sprinkler system including a network of water pipes having an interior volume, a water input port opening the interior space, and a plurality of water outlet ports further opening the interior space, the network of water pipes having an internal fluid at a pressure reduced below that of the outside atmosphere; a plurality of blow off caps for resisting aspiration of air into the water outlet ports and for permitting emission of water flowing under pressure from the water outlet ports, the blow off caps covering the water outlet ports, the blow off caps being adapted to permit air to aspirate into the interior space of the water pipe network upon exposure of such network to heat; a valve actuatable by a pressure rise, such valve operatively connected to the water input port; a pump for lowering the internal fluid pressure of the network of water pipes below that of the atmospheric pressure; and a pilot line for communicating a rise in pressure within the water pipe network to the valve.

9 Claims, 7 Drawing Sheets

DELUGE FIRE SPRINKLER SYSTEM

FIELD OF THE INVENTION

This invention relates to fire extinguishing systems adapted for inundating an entire fire hazard zone with water upon heat sensing of a fire ignition point within said zone.

BACKGROUND OF THE INVENTION

Closed head or closed orifice fire sprinkler systems are economically constructed, typically requiring no automatically opening deluge valve, and requiring no auxiliary heat sensitive deluge valve actuating means. Closed head fire sprinkler systems typically contain pressurized water, and closed orifice sprinkler heads at the terminal water output ends of such system withhold the water in the absence of fire. Upon exposure of one of the sprinkler heads of a closed head sprinkler system to heat from a fire, a heat fusible link incorporated in the sprinkler head fractures, opening such sprinkler head for local water dispersion.

A chief disadvantage of closed head sprinkler systems is that each sprinkler head of such system is individually responsive to heat. The opening of one of the sprinkler heads of a closed head sprinkler system does not open any other sprinkler head within the system. If a closed head sprinkler system were installed within a high risk fire hazard zone, such system would be unable to effectively suppress a rapidly spreading fire. Thus, closed head sprinkler systems are not commonly utilized in high risk fire hazard zones.

Fire sprinkler systems utilized in high risk fire hazard zones are necessarily adapted to instantly inundate an entire fire hazard zone with water in response to a localized fire ignition point within the zone. Through inundation of an entire zone, water flow is established in advance of a rapidly spreading fire, increasing the likelihood that the sprinkler system will effectively suppress the fire. Such fire sprinkler systems, commonly referred to a deluge systems, utilize open orifice sprinkler heads at the terminal water output ports of the system. The open terminal ends of a deluge system cannot withhold water under pressure. Therefore, an automatically opening deluge valve for restricting water flow at the input end of the system is normally utilized. The deluge valve of a deluge fire sprinkler system is normally closed, necessitating the provision of means for automatically opening such valve upon the occurrence of a fire at any point within the fire hazard zone. Known means for automatically opening such deluge valves comprise a fluid pressure actuated main valve installed in combination with a network of pressurized tubes, such network being co-extensive with the water pipes of the deluge system. The terminal ends of such network of tubes typically have heat sensing fluid release valves. Upon actuation of any one of the fluid release valves of the network of tubes, such network experiences an overall drop or rise in fluid pressure, actuating the deluge valve to allow a flow of pressurized water throughout the water pipes of the system, causing substantially simultaneous emission of water from the system's open sprinkler heads.

Another known means for automatically opening the deluge valve of a deluge sprinkler system comprises an electrically actuated main valve installed in combination with a network of electric lines installed co-extensively with the network of water pipes. The terminal ends of the network of electric lines commonly include electric switches sensitive to heat, ultraviolet or infra-red radiation, the closing or opening of any one of which opens the deluge valve, releasing a flow of pressurized water throughout the system.

Open head deluge fire extinguishing systems typically are more expensive to install and maintain than closed head systems because of the requirement of installing and maintaining a fire sensing network of tubes or electrical lines in addition to the fire extinguishing water distribution piping. The instant inventive deluge fire sprinkler system eliminates such additional expense by allowing fluid contained within the water pipes of the system to serve as an integral part of its means for automatically opening its deluge valve. By eliminating the need of a separate heat sensing network, the expense of the instant inventive deluge fire sprinkler system may be equal or less than that of a closed head system.

BRIEF SUMMARY OF THE INVENTION

A preferred embodiment of the instant inventive deluge fire sprinkler system comprises a main water supply pipe providing water at a pressure of approximately 90 p.s.i., or other pressure appropriate to hydraulic design. Water flow provided by the main pipe is preferably controlled by a diaphragm valve, such valve having a ventable upper chamber, a water input port, and a lower chamber annularly surrounding the water input port, the lower chamber having a water output port. The diaphragm of such valve separates the two chambers and normally closes the water input port. Under normal circumstances, water pressure within the upper chamber biases the diaphragm to close the valve, preventing a flow of water into the pipe network of the sprinkler system. Upon venting of water from the upper chamber of such valve, the diaphragm moves to open the valve, allowing water from the main pipe to spill into the lower chamber, through its output port, and into the network of pipes. The upper chamber of such diaphragm valve preferably has a vent tube which is normally closed by a fluid pressure actuated valve or by an electric solenoid valve. Where a fluid pressure actuated valve is utilized, it is preferable that a fluid pressure pilot line extend from such valve to a convenient point in the water pipe network, such pilot line serving to communicate a rise in fluid pressure within the pipe network to the fluid pressure actuated valve. Where an electric solenoid valve is utilized to control water flow from the vent of the upper chamber of the diaphragm valve, it is preferable that such solenoid valve be actuated by a fluid pressure sensing electric switch installed at some convenient point upon the water pipe system, such pressure sensing switch being adapted to open the electric solenoid actuated valve upon a rise in fluid pressure within the water pipe network. In either case, whether a fluid pressure actuated valve or an electric solenoid valve is utilized, a rise in fluid pressure within the water pipe network results in venting of water from the upper chamber of the diaphragm valve, opening such valve to a flow of pressurized water throughout the deluge system.

While it is preferred that a diaphragm valve be selected as the inventive system's automatic deluge valve, other types of deluge valves actuatable by a rise in fluid pressure within the system may be utilized. For example, an electric servo motor actuated gate valve controlled by a pressure sensing electric switch may be utilized. As further examples, pneumatic or electric release deluge valves as manufactured by the Viking Company or by the Reliable Automatic Sprinkler Co., Inc., may be suitably utilized to release a flow of pressurized water into the deluge system in response to a rise in fluid pressure within the pipe network. The pinch valve described in U.S. Pat. No. 3,759,331 issued on Sep. 18, 1973 to Livingston provides a further example. Other valves responsive to and actuatable by a pressure rise within the pipe network fall within the scope of the invention and may be suitably utilized.

In order for the network of water pipes of the instant inventive system to be capable of experiencing a rise in fluid pressure, it is necessary that a negative pressure differential exist between the interior fluid, typically gas, of the system and the outside atmosphere. When a negative pressure differential is maintained, the internal fluid pressure of the system is depressed below that of the outside atmosphere. A preferred means of inducing such negative pressure differential is to utilize a pump to draw fluid from a fluid output port extending through the wall of one of the pipes of the system. Less desirably, though suitably, mechanical means for increasing the internal volume of the pipe network may be utilized to rarefy the fluid within such network, resulting in the requisite negative pressure differential. Other means for inducing the requisite negative pressure differential fall within the scope of invention and may be suitably utilized.

The terminal water emitting ends of the inventive deluge fire sprinkler system preferably are configured as nozzles, each nozzle having a water output port, and each nozzle having a water dispersing element situated so that water emitting from the water output port strikes the water dispersing element. In order for the inventive system to maintain, in the absence of fire, the requisite negative fluid pressure differential, it is preferable that each nozzle's water output port have means applied thereto for resisting aspiration of air while permitting emission of pressurized water. A preferred means for accomplishing such objects comprises blow off caps covering each of the water output ports of the system's nozzles. A less desirable, though suitable, means for resisting air aspiration while permitting water emission comprises blow out plugs installed within the water output ports. Other means for resisting aspiration of air into the water output ports of the nozzles while permitting emission of pressurized water fall within the scope of the invention, and may be suitably utilized.

Heat responsive air aspiration means, preferably applied to the nozzles, are utilized for inducing a rise in fluid pressure within the water pipe system in order to actuate and open the deluge valve in the event of fire. Since the inventive system preferably includes nozzles having water output ports, and since each such port may dually serve as an air aspiration port, it is preferable, though not necessary, that the heat responsive air aspiration means comprise the water output ports of the nozzles. Allowing the heat responsive air aspiration means to comprise the water output ports of the nozzles avoids the requirement of additional apertures and conveniently locates the heat responsive air aspiration means throughout the deluge system in accordance with the nozzle matrix of the system, this being the most appropriate location for heat sensitivity within the hazard area.

Where the water output ports of the nozzles dually serve as the air aspiration ports of the heat responsive air aspiration means, and where, for example, blow off caps are used, provision must be made for overriding the air aspiration resisting function of at least one of such caps in the event of a fire. A preferred means of achieving such object is to fabricate the caps from a heat fusible lead alloy, a heat frangible material or a thermoplastic material. Where a blow off cap comprises such material, exposure of the cap to heat deforms, fractures, or degrades the cap, causing the cap to cease to perform its air aspiration preventing function.

An alternate, though less preferable, means of causing at least one of such exemplary blow off caps to cease to perform its air aspiration preventing function in the presence of heat is to provide heat responsive mechanical means for removing such cap. A simple example of a heat responsive mechanical cap removing means comprises a helical spring mounted over the water output port of the nozzle, such spring being held in compression by a heat fusible spring stop. Upon exposure of the heat fusible spring stop to heat from a fire, such stop ceases to perform its spring retaining function, allowing the spring to drive the blow off cap away from the water output port, and causing such cap to cease to perform its air aspiration resisting function. Other mechanical heat responsive means for causing the blow off cap, or blow out plug, as the case may be, to cease to perform its air aspiration resisting function fall within the scope of the invention, and may be suitable utilized.

Accordingly, it is an object of the present invention to provide a deluge fire sprinkler system which eliminates the need for a pilot line heat sensing network or an electrical heat sensing network.

It is a further object to provide such a system having a deluge valve which is automatically openable in response to a rise in fluid pressure within the water distribution pipes of the system.

It is a further object to provide such a system incorporating means for maintaining a negative fluid pressure differential under normal circumstances when fire is absent.

It is a further object to provide such a system incorporating heat responsive air aspiration means for triggering the deluge valve upon exposure of such means to heat from a fire.

Other and further objects of the invention will become known to those skilled in the art upon review of the Detailed Description which follows, and upon review of the appended drawings.

DETAILED DESCRIPTION OF EXEMPLARY EMBODIMENTS

Figure 5:
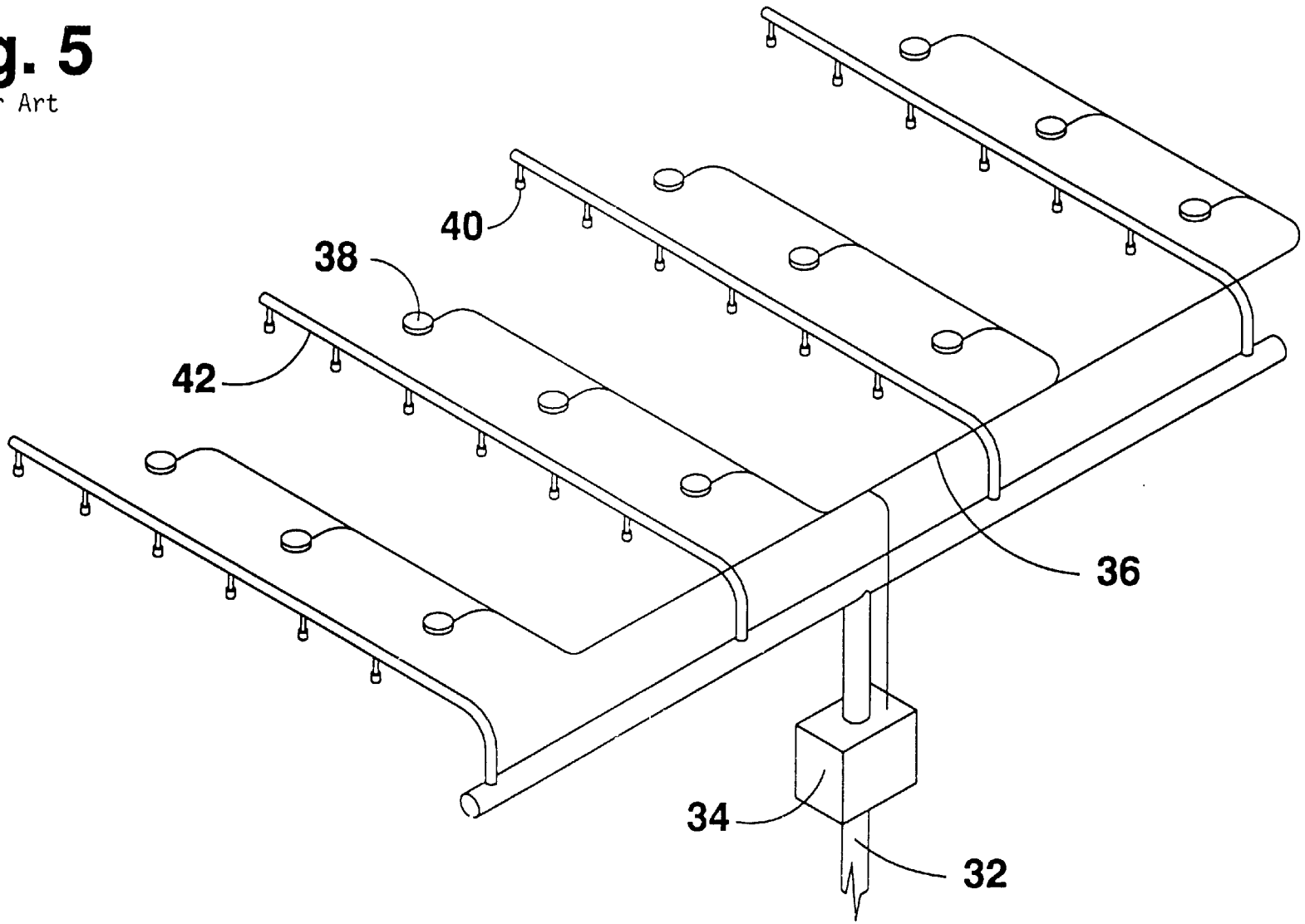
Fig. 5 Prior Art
FIG. 5 is a representational drawing of a conventional deluge fire sprinkler system.

Referring to FIG. 5, which depicts a conventional deluge fire sprinkler system, such system has a main water supply pipe 32 controlled by a normally closed automatic deluge valve 34. Open head or open orifice sprinkler heads 40 typically form an integral part of and an extension of the terminal ends of pipes 42. Under normal circumstances in the absence of fire, the deluge valve 34 remains closed, causing water pipes 42 throughout the system to remain dry, preventing emission of water from the open orifice of sprinkler heads 40. A network of sensor lines 36 and heat sensor heads 38 is adapted to detect the presence of fire at any point within the fire hazard zone protected by the system. Upon detection of fire, such network signals the deluge valve 34 to open, allowing water to substantially simultaneously emit from all of the sprinkler heads 40. The lines 36 may conventionally be pneumatic or electrical, and the heat sensing heads 38 may be pressure releasing in response to heat, negative pressure relieving in response to heat, or may be adapted to close or open an electrical circuit in response to heat. Installation of lines 36 and heat sensing heads 38 as an integral part of a conventional deluge fire extinguishing system can be mechanically or operationally difficult, and is costly. Because of the location of heat sensing devices at the exact point of water release, the instant inventive deluge fire sprinkler system functions more effectively than conventional deluge fire extinguishing systems such as depicted in FIG. 5, while eliminating the mechanical complexity and cost of lines 36 and heat sensing heads 38.

Figure 1:
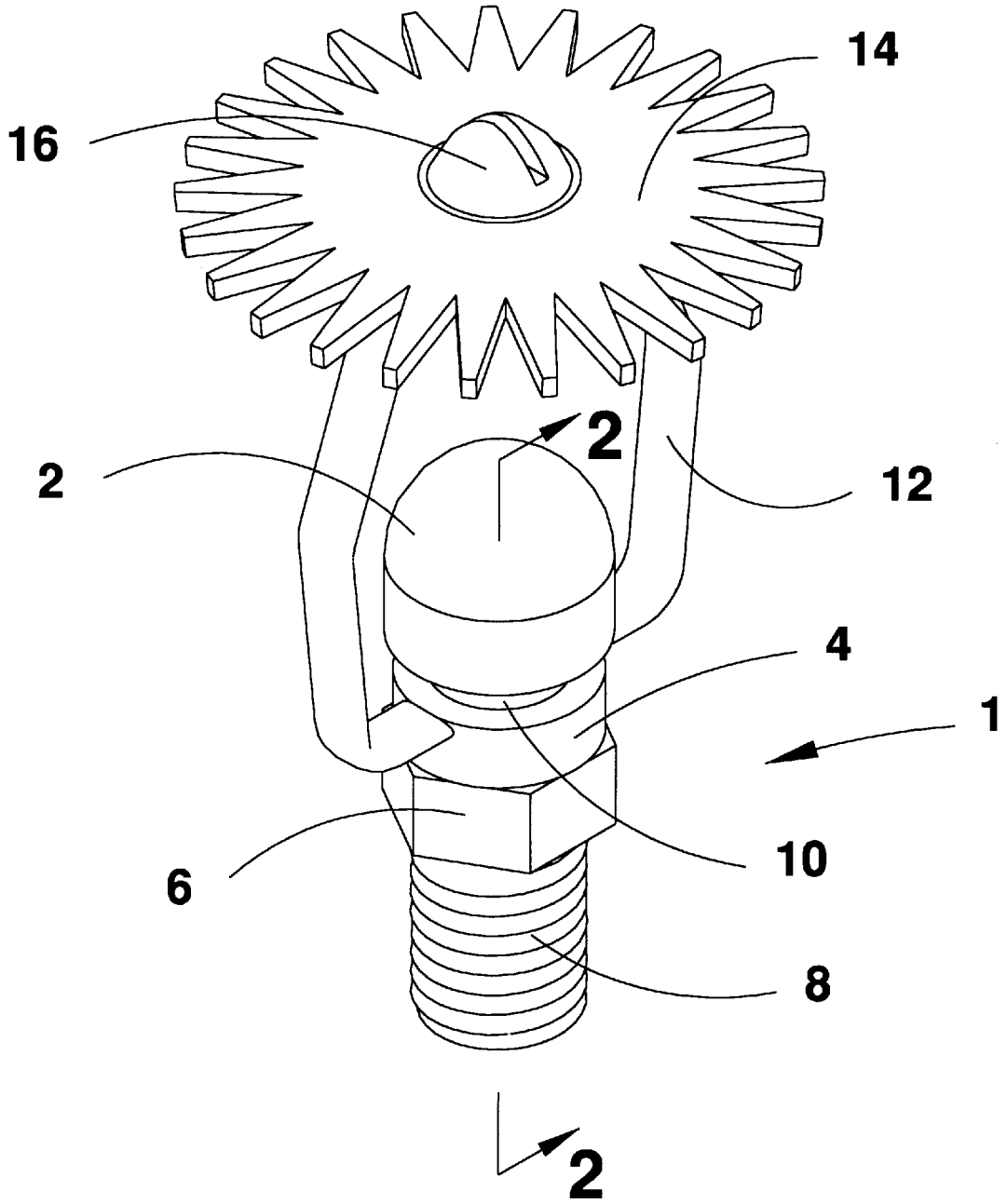
FIG. 1 is an isometric view of an exemplary sprinkler head nozzle utilizable in the inventive system.

Referring to Drawing FIG. 1, reference arrow 1 designates an exemplary nozzle which may be utilized as a component of the instant inventive deluge fire sprinkler system. The nozzle 1 has a cylindrical body 4, such body 4 having, referring to FIG. 2, a hollow bore 18 extending longitudinally therethrough. Referring again to FIG. 1, the cylindrical body 4 has at its lower end spiral threads 8 facilitating threaded mounting of the nozzle 1 into spirally threaded apertures through the walls of, referring to FIG. 6, water pipes 60 of the inventive system. Referring again to FIG. 1, it is preferable that the nozzle 1 has hexagonally oriented faces 6 allowing the nozzle 1 to be conveniently installed by means of a wrench. The nozzles 1 may be manufactured from conventional materials such as brass or plated alloys, or from inexpensive injection molded plastic.

Figure 2:
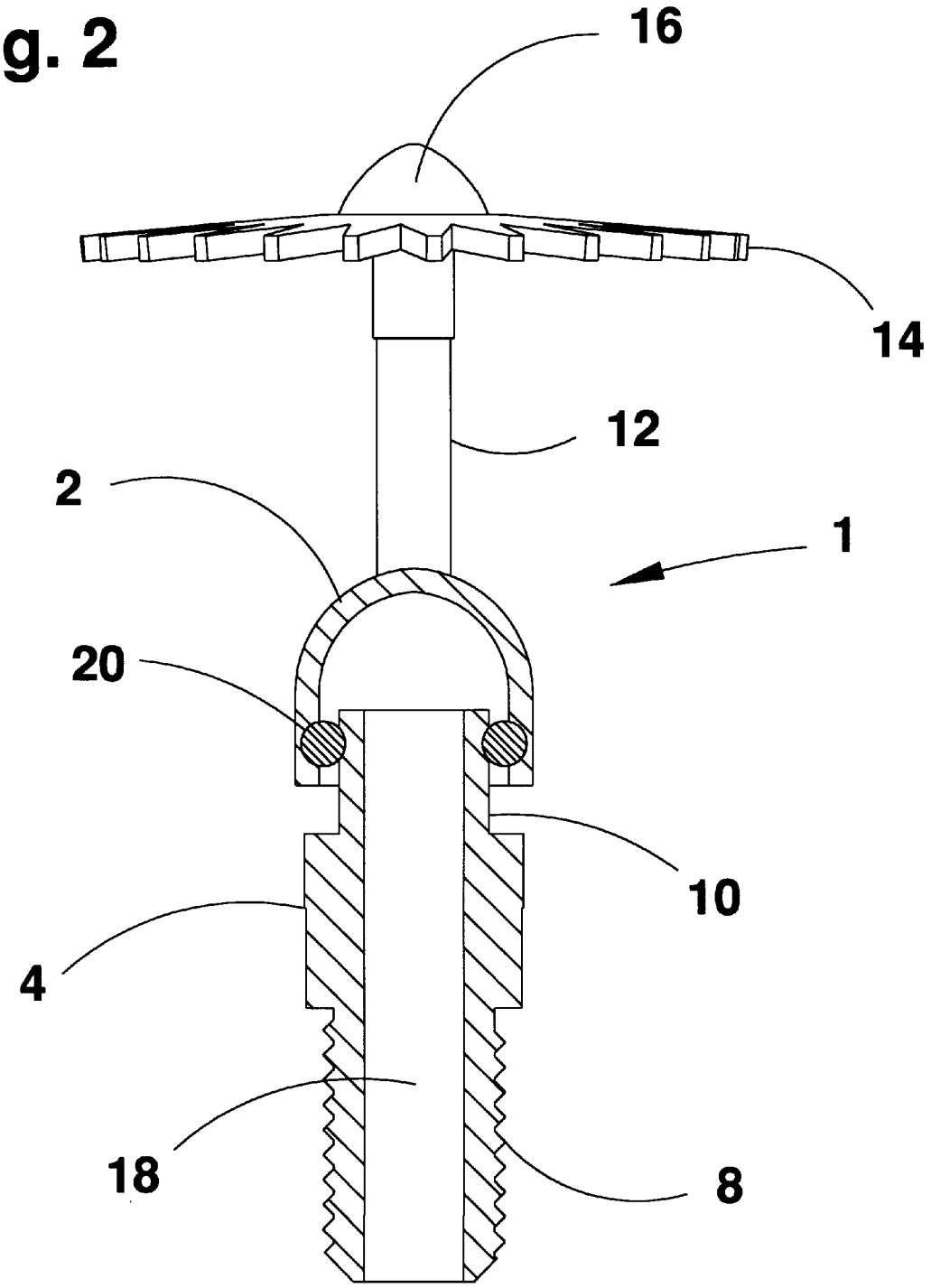
FIG. 2 is a sectional view of the sprinkler head nozzle depicted in FIG. 1, as indicated in FIG. 1.

Referring simultaneously to FIGS. 1 and 2, the upper end of the cylindrical body 4 of the nozzle 1 forms a water output port 10. The upper end of the output port 10 is covered by a blow off cap 2, such cap being secured in place by a flexible rubber "O" ring 20. Preferably, the annular inner surface of the blow off cap 2 and the annular outer surface of the water output port 10 form annular "O" ring receiving channels for securely receiving and retaining the "O" ring 20. The blow off cap 2 is formed from a heat fusible, heat frangible, or heat deformable material such as lead alloy, thermoplastics, or glass. Preferably, the upper end of the blow off cap 2 extends convexly upward, increasing the surface area of the blow off cap 2, and increasing its responsiveness to heat.

For convenience of installation and reinstallation of the blow off caps, a loose tether or chain (not depicted) may interlink the nozzle 1 and the blow off cap 2, such tether or chain preventing the blow off cap 2 from falling away from the nozzle 1 while leaving the blow off action unrestricted.

Referring further simultaneously to FIGS. 1 and 2, under normal conditions experienced by the inventive system, fluid, typically, though not necessarily, a gas, contained within the hollow bore 18 is maintained at a pressure below than that of the outside atmosphere. A negative pressure differential of 5 to 8 p.s.i. is preferred. By maintaining a low negative pressure differential, the sensitivity of the responsiveness of the system to heat may be enhanced. While such negative pressure differential exists, the "O" ring 20 provides an occlusive seal between the blow off cap 2 and the upper opening of the water output port 10, preventing aspiration of air from the outside atmosphere into the hollow bore 18.

Referring further simultaneously to FIGS. 1 and 2, upon exposure of the convex outer surface of the blow off cap 2 to heat from a fire, such surface deforms and fractures, allowing air to aspirate into the hollow bore 18, relieving the negative pressure differential and causing a rise in pressure within said bore 18, and throughout the piping system.

Referring further simultaneously to FIGS. 1 and 2, upon injection of pressurized water into the lower end of the hollow bore 18 of the nozzle 1, such water drives upwardly through said hollow bore 18 coming into pressurized contact, or causing air driven by the water to come into pressurized contact, with the inner surfaces of the blow off cap 2. Such pressurized contact drives the blow off cap 2 away from the water output port 10, allowing emission of the water from the water output port 10.

Referring to FIG. 1, a support bracket 12 extends upwardly from and is fixedly attached to the cylindrical body 4 of the nozzle 1. The support bracket 12 supports a water dispersion plate 14, such plate being fixedly attached to the upper end of the support bracket 12 by a threaded screw 16. Referring simultaneously to FIGS. 1 and 2, water emitting from the water output port 10 comes into contact with and is widely dispersed by the water dispersion plate 14 for fire suppression over a wide area.

The exemplary nozzle 1 depicted in FIGS. 1 and 2 functions independently of its orientation, and references above to its upper and lower ends are solely for convenience of description. Such nozzle 1 may be oriented as a component of the inventive system so that water emitting from the water output port 10 sprays upwardly, downwardly, or horizontally.

Figure 3:
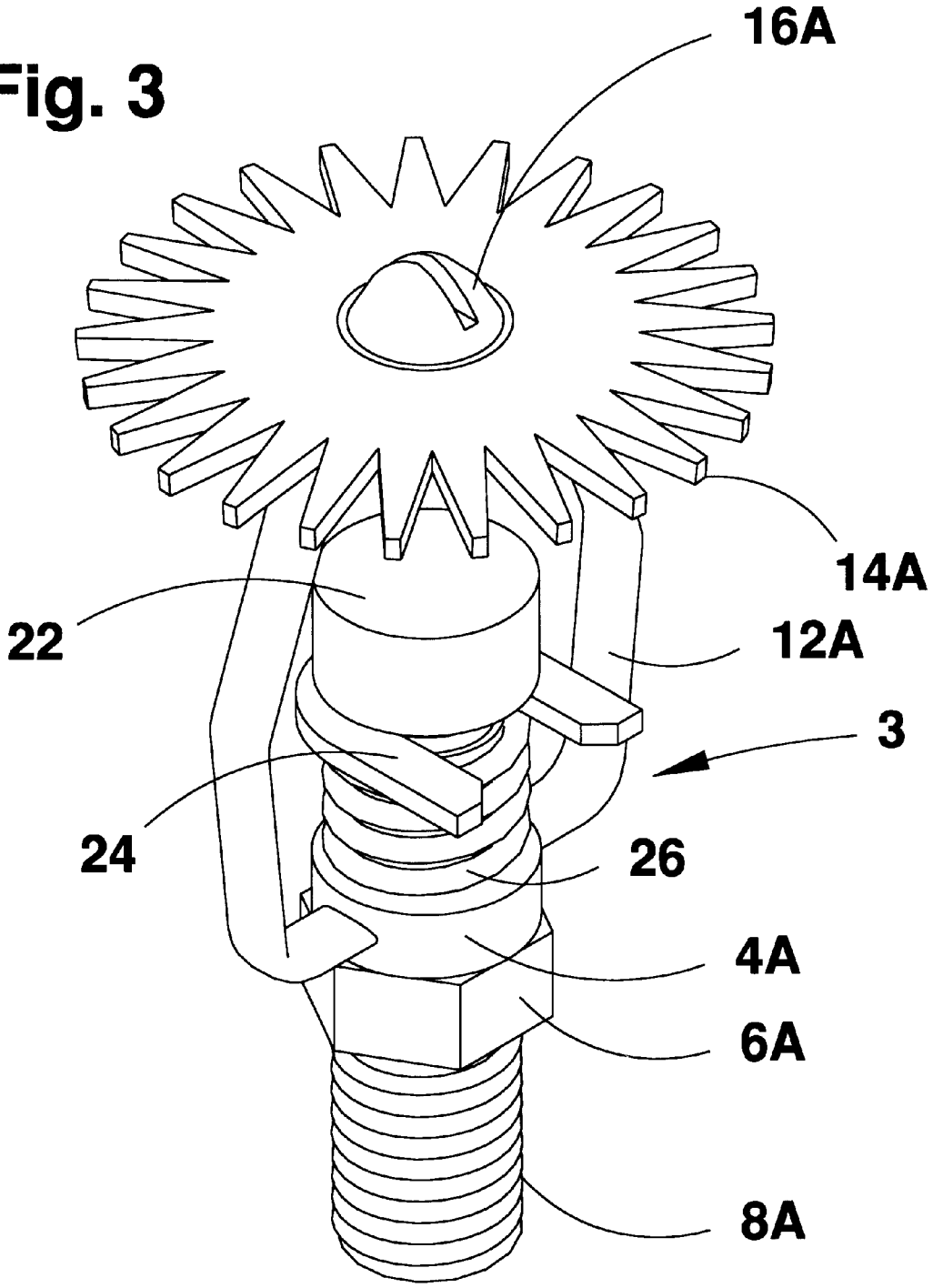
FIG. 3 is an isometric view of a second exemplary sprinkler head nozzle utilizable in the inventive system.
Figure 4:
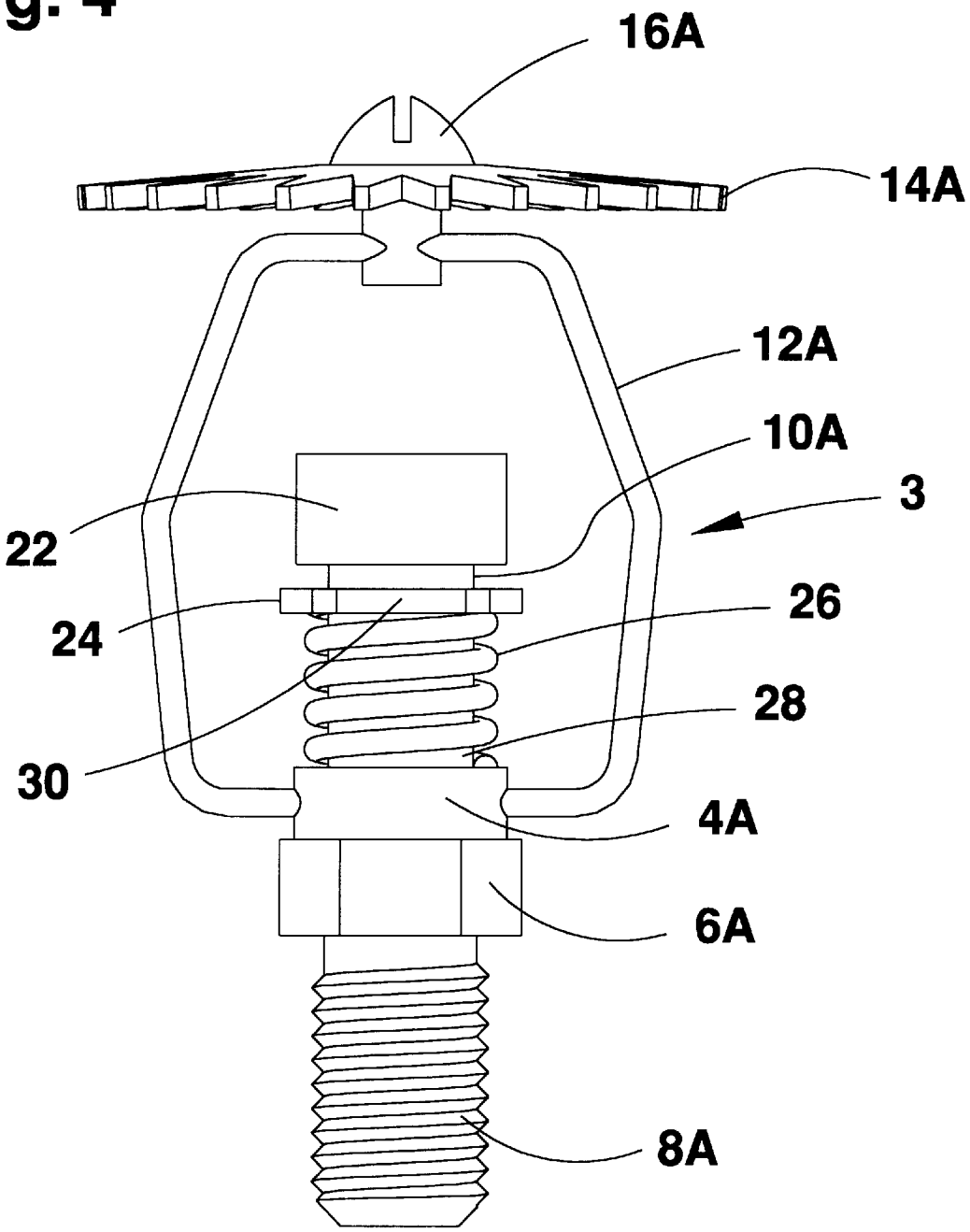
FIG. 4 is a side elevation of the sprinkler head nozzle depicted in FIG. 3.

Referring to FIGS. 3 and 4, reference arrow 3 designates a second less preferable exemplary nozzle utilizable as a component of the present inventive deluge fire sprinkler system. Each element of FIGS. 3 and 4 denoted by a reference numeral having the suffix "A" is substantially identical to similarly numbered elements depicted in FIGS. 1 and 2. While blow off cap 22 may be composed of a heat fusible, heat frangible, or heat deformable material, as is blow off cap 2 depicted in FIGS. 1 and 2, blow off cap 22 is not necessarily heat fusible or deformable.

Instead of relying upon heat deformation or fracturing as a means of overriding blow off cap 22's resistance to air aspiration, the exemplary nozzle 3 comprises an elongated section 28 of the water output port 10A, such elongated section 28 having at its upper end a spring stop receiving channel 30. A heat fusible or heat deformable "U" shaped spring stop 24 is slidably mounted over the water output port 10A so that it is retained by the spring stop receiving channel 30; such spring stop 24 holding a compression spring 26 annularly mounted over the elongated section 28, in a compressed state. Upon exposure of the nozzle 3 to heat, the spring stop 24 fuses or deforms, thereby ceasing to perform its spring stopping function. The spring 26 then extends upwardly, driving blow off cap 22 away from water output port 10A, and causing said cap to cease to perform its air aspiration resisting function. Aside from its means for overriding the air aspiration resisting function of cap 22, nozzle 3 depicted in FIGS. 3 and 4 operates in the same manner as nozzle 1 depicted in FIGS. 1 and 2.

Referring to FIG. 2, it can be seen that a blowout plug (not depicted) inserted into the upper end of hollow bore 18 could resist aspiration of air while permitting emission of water just as effectively as the blow off cap 2. However, utilization of a blow out plug is not preferred because it is difficult to configure a blow out plug to be sufficiently heat deformable, heat frangible or heat fusible; and, alternately, because blow off caps are more easily mechanically removed from an output port covering position. Nevertheless, blow out plugs, along with other output port covering articles or mechanisms, are considered to fall with the scope of the invention.

FIGS. 1–4 represent two suitable exemplary means for resisting air aspiration and permitting emission of pressurized water under normal circumstances in absence of fire while overriding the air aspiration resisting function in the presence of heat from a fire. Numerous other mechanical configurations may perform the same objects. For example, referring to FIG. 4, it can be seen that, upon inverting the nozzle 3, and upon replacing the compression spring 26 with a weighted slide collar (not depicted), the nozzle 3 could perform said objects. Heat fusion or deformation of "weight" stop 24 would allow such weighted collar to drop onto the blow off cap 22, just as it releases spring energy against the blow off cap 22. Upon provision of sufficient weight falling onto the blow off cap 22, such cap may be driven away from the water output port 10A. Other mechanical configurations such as those incorporating a heat expansible actuator (not depicted) may allow heat from a fire to more directly perform work upon the blow off cap, removing such cap. Whatever means or mechanism is utilized to cause the nozzle, or other air aspiration port, to aspirate air in response to heat is considered to fall within the scope of the invention.

Figure 6:
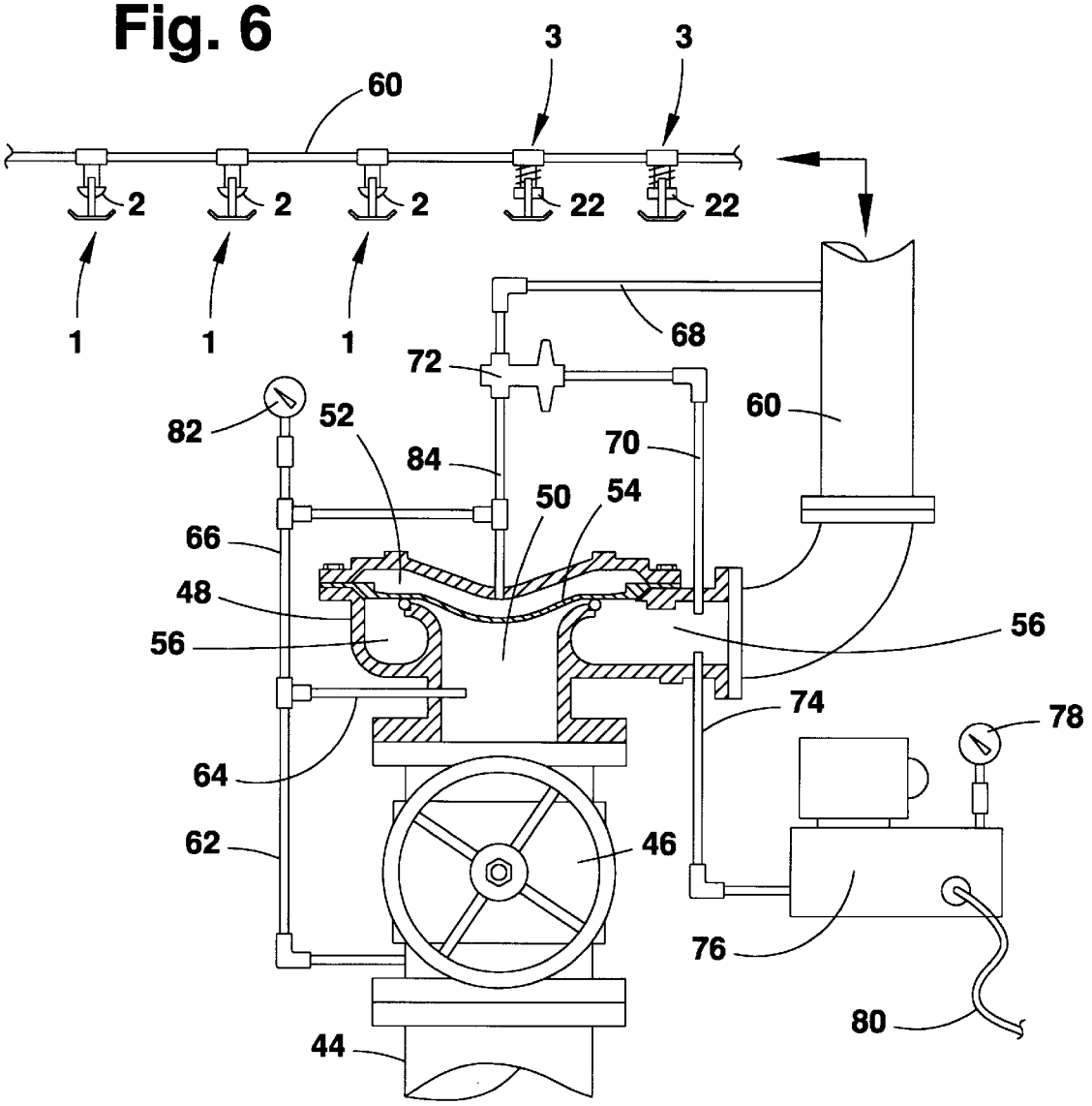
FIG. 6 is a representational drawing of an exemplary configuration of the present inventive system.

Referring to the representational drawing of FIG. 6, a preferred valve utilized in the present inventive deluge fire sprinkler system comprises a diaphragm valve 48, the diaphragm valve having an upper chamber 52, and a lower chamber 56, the upper and lower chambers being separated by a flexible diaphragm 54. Water flowing through main water pipe 44 enters the water input port 50 of the diaphragm valve 48. Under normal circumstances in the absence of fire within the fire hazard zone protected by the inventive system, water flows only from the water input port 50 through bypass tubes 64 and 66 to fill and pressurize the upper chamber 52 through vent tube 84. A diaphragm surface area differential between the surface exposed to the water input port 50 and the surface exposed to the upper chamber 52 allows equal water pressure between the upper chamber 52 and the water input port 50 to close the upper end of the water input port 50, preventing water from flowing into the lower chamber 56. The lower chamber 56 opens into the sprinkler system pipes 60. Water is restricted from flowing from diaphragm valve 48 to pipes 60 while fluid pressure remains equal between such valve's upper chamber 52 and water input port 50.

Referring further to FIG. 6, an automatic pressure maintaining pump 76 is preferably utilized to draw fluid, typically gas, from the sprinkler system pipes 60 via vacuum tube 74. The pump 76 maintains the fluid pressure within the system under normal circumstances at a negative pressure differential between 5 and 8 p.s.i. below the atmospheric pressure. Preferably, the pump 76 is electrically powered via an electric power cord 80, and preferably such pump has a pressure gauge 78 for visual monitoring of the required negative pressure differential. While utilization of a pump for creating and maintaining the requisite negative pressure differential is preferred other mechanical means for increasing the contiguous volume of the water pipe network and rarefying fluid therein are considered to fall within the scope of the invention. Preferably, the pump 76 is a low capacity pump arranged to draw air through a restriction orifice so that, upon heat actuated aspiration of air into the water pipe network, the pump 76 will be incapable of maintaining a negative pressure differential.

Referring simultaneously to FIGS. 2 and 6, sprinkler heads depicted in FIGS. 1 and 2 are referred to by reference arrows 1, and sprinkler heads depicted in FIGS. 3 and 4 are referred to by reference arrows 3. In the event of a fire within the hazard zone protected by the system, a blow off cap 2 or 22, as the case may be, is either heat fractured or deformed, or removed through the action of a spring, allowing air to aspirate through the nozzle which is heated by the fire. Such aspiration of air results in a rise in fluid pressure within the internal volume of the sprinkler system pipes 60 and within pilot tube 68. Such rise in fluid pressure within pilot tube 68 causes a fluid pressure actuated valve 72 to open, allowing venting of water from the upper chamber 52 of the diaphragm valve 48. Upon venting of water from the upper chamber 52, water pressure within the water input port 50 is able to drive the diaphragm 54 upwardly, opening the water input port 50 to a flow of pressurized water into the lower chamber 56, and thence into the sprinkler system pipes 60 for substantially simultaneous emission from all of the nozzles 1 and 3 in the system. Such water flow blows off all of the blow off caps 2 or 22 of the system.

Referring further to FIG. 6, it is preferable that a second pilot line 70 extend from the lower chamber 56 to the fluid pressure actuated valve 72; pressure from such line 70 holding valve 72 in its opened position.

Referring further to FIG. 6, a manually operated gate valve 46 is preferably provided to allow an operator to selectively shut off water flow to the system. When such manually operated valve 46 is provided, it is preferable that a bypass line 62 serve to supply water pressure to the upper chamber 52 of the diaphragm valve 48 when valve 46 is closed. Preferably, a water pressure gauge 82 is provided in line with bypass line 66 for visual monitoring of water pressure available to the system.

Figure 7:
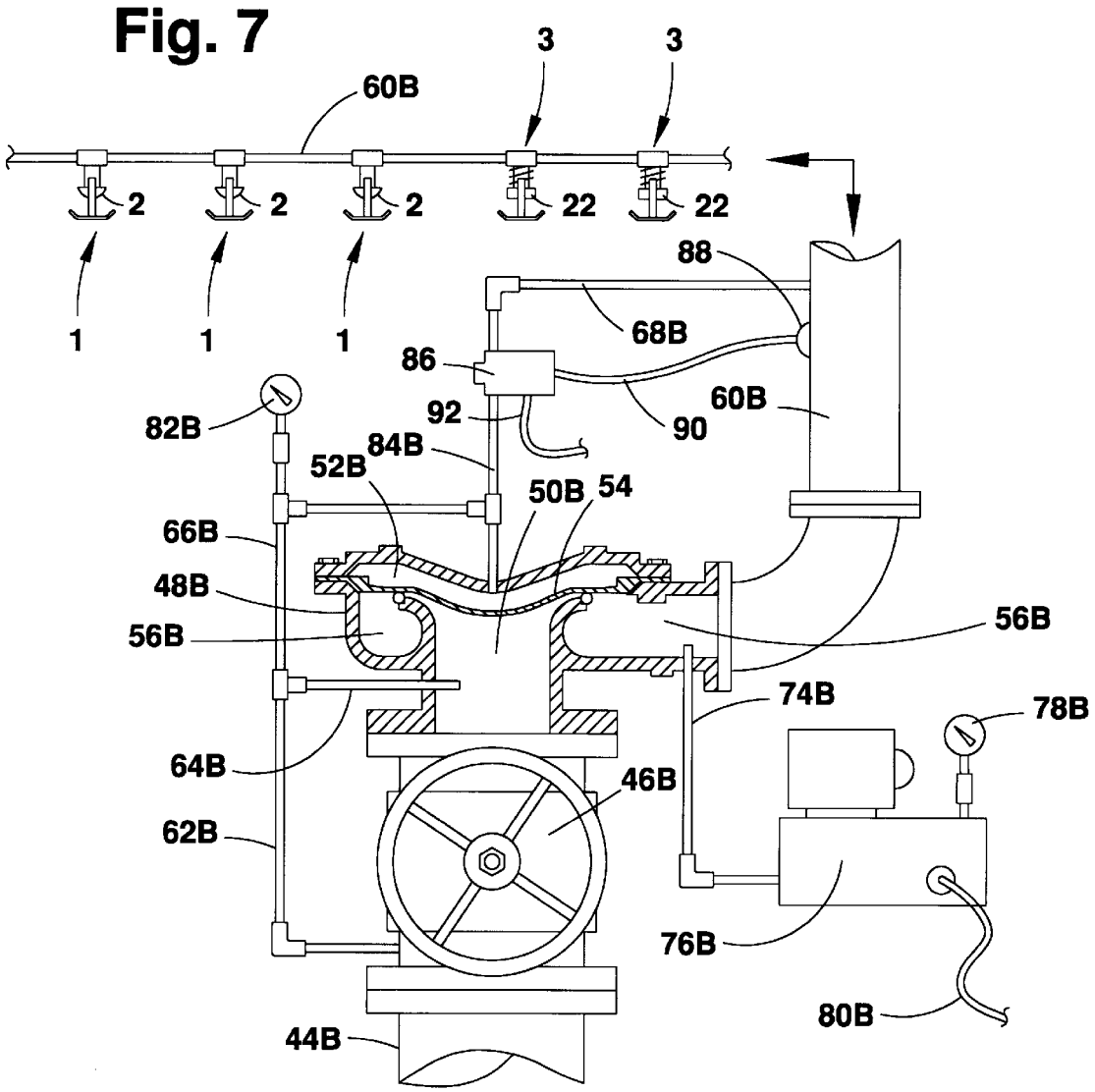
FIG. 7 is a representational drawing of a second exemplary configuration of the present inventive system.

Referring simultaneously to FIGS. 6 and 7, all of the elements in FIG. 7 identified by a reference numeral having a suffix "B" are substantially identical to similarly numbered elements appearing in FIG. 6. Instead of utilizing the fluid pressure actuated valve 72 of the system depicted in FIG. 6, the system representationally depicted in FIG. 7 utilizes an electric motor means, preferably configured as an electric solenoid actuated valve 86, such valve being powered via an electric power cord 92. The supplied electric power travels in an electric circuit, including electric wires 90 and fluid pressure sensing switch 88, such switch being installed within a wall of pipe 60B. Upon a rise in fluid pressure within sprinkler system pipes 60B, the pressure sensing switch 80, either closes or opens, actuating electric solenoid 86 to open, allowing venting of water from upper chamber 52B.

While the diaphragm valve configurations depicted in FIGS. 6 and 7 are preferred, numerous other fluid pressure actuated valves fall within the scope of the invention and may be suitably utilized.

The principles of the inventive system have been made clear in the above exemplary embodiments. Those skilled in the art likely will be able to make modifications in the structure, arrangement, portions and components of the inventive system without departing from those principles. Accordingly, it is intended that the description and drawings be interpreted as illustrative and not in a limiting sense. The invention should be recognized as having a scope commensurate with the appended claims.

I claim:

1. A deluge fire sprinkler system for suppressing fires occurring in an air environment, the air having an atmospheric pressure, the deluge fire sprinkler system comprising:

(a) a network of water pipes having an interior volume, a water input port opening the interior volume, and a plurality of water outlet ports further opening the interior volume, the network of water pipes having an internal fluid pressure;

(b) means for resisting aspiration of air into the water outlet ports and for permitting emission of water flowing under pressure from the water outlet ports, said means covering the water outlet ports;

(c) heat actuatable air aspiration means operatively connected to the water pipe network and adapted to permit air to flow into the interior volume of the water pipe network upon exposure of such network to heat;

(d) a valve operatively connected to the water input port;

(e) means for lowering the internal fluid pressure of the network of water pipes below that of the atmospheric pressure; and, (f) pressure actuatable valve opening means operatively connected to the valve and adapted to open the valve upon a rise in fluid pressure within the interior volume of the water pipe network.

2. The deluge fire sprinkler system of claim 1 wherein the fluid pressure lowering means comprises a pump, and further comprising a fluid outlet port to which said pump is operatively connected, said port further opening the interior volume of the water pipe network.

3. The deluge fire sprinkler system of claim 2 wherein the water pipe network has a plurality of terminal ends, each terminal end forming a water dispersing nozzle, the water dispersing nozzles comprising the water outlet ports.

4. The deluge fire sprinkler system of claim 3 wherein the heat actuatable air aspiration means comprise heat fusible, heat frangible, or heat deformable blow off caps or blow out plugs, the means for resisting air aspiration and for permitting water emission comprising such caps or plugs.

5. The deluge fire sprinkler system of claim 3 wherein the means for resisting air aspiration and for permitting water emission comprises blow off caps or blow out plugs, and wherein the heat actuatable air aspiration means comprises heat responsive mechanical cap or plug removing means.

6. The deluge fire sprinkler system of claim 4 wherein the pressure actuatable valve opening means comprises a pressure sensing electric switch, said switch being actuatable by a rise in fluid pressure within the interior volume of the water pipe network, and further comprising electric motor means, the pressure sensing electric switch being operatively connected to the electric motor means, the electric motor means being adapted for opening the valve.

7. The deluge fire sprinkler system of claim 5 wherein the pressure actuatable valve opening means comprises a pressure sensing electric switch, said switch being actuatable by a rise in fluid pressure within the interior volume of the water pipe network, and further comprising electric motor means, the pressure sensing electric switch being operatively connected to the electric motor means, the electric motor means being adapted for opening the valve.

8. The deluge fire sprinkler system of claim 4 wherein the pressure actuatable valve opening means comprises a pilot line extending from the water pipe network to the valve, the valve being adapted to open in response to a rise in fluid pressure within the pilot line.

9. The deluge fire sprinkler system of claim 5 wherein the pressure actuatable valve opening means comprises a pilot line extending from the water pipe network to the valve, the valve being adapted to open in response to a rise in fluid pressure within the pilot line.

* * * * *